United States Patent [19]

Kato et al.

[11] 4,262,230

[45] Apr. 14, 1981

[54] STORAGE TARGET FOR DIRECT-VIEW STORAGE TUBES

[75] Inventors: Takefumi Kato, Hinode; Hajime Takita, Hino, both of Japan

[73] Assignee: Iwatsu Electric Co., Ltd., Tokyo, Japan

[21] Appl. No.: 1,838

[22] Filed: Jan. 8, 1979

[30] Foreign Application Priority Data

Jan. 19, 1978 [JP] Japan ..... 53/4567

[51] Int. Cl.[3] ..... H01J 29/08; H01J 29/36

[52] U.S. Cl. ..... 313/395; 313/397

[58] Field of Search ..... 313/395, 397

[56] References Cited

U.S. PATENT DOCUMENTS

| | | | |
|---|---|---|---|
| 3,031,597 | 4/1962 | Davis | 313/397 X |
| 3,377,513 | 4/1968 | Ashby et al. | 357/4 X |
| 3,476,617 | 11/1969 | Robinson | 357/4 X |
| 3,579,012 | 5/1971 | Zwicker et al. | 313/366 |
| 3,710,179 | 1/1973 | Hayes et al. | 313/395 X |
| 3,798,494 | 3/1974 | Curtin | 313/392 X |
| 3,975,656 | 1/1975 | Newton et al. | 313/395 X |

*Primary Examiner*—Palmer C. Demeo

*Attorney, Agent, or Firm*—Woodcock, Washburn, Kurtz, Mackiewicz & Norris

[57] ABSTRACT

A storage target includes a dielectric storage medium in the form of a relatively rigid sheet of insulating material having high density, such as a single crystal sheet of sapphire. A film electrode is formed, as by vapor deposition of nickel or like conductive material, on one of the surfaces of the storage medium. An array of openings are defined by and extend through the storage medium and film electrode. In some embodiments the collector electrode of a direct-view storage tube is formed on the other surface of the storage medium, also as by vapor deposition of nickel and subsequent etching.

8 Claims, 14 Drawing Figures

STORAGE TARGET FOR DIRECT-VIEW STORAGE TUBES

BACKGROUND OF THE INVENTION

1. Field of the Invention

Our invention pertains to storage tubes, and in particular to direct-view or display storage tubes adaptable for storage-type oscilloscopes and other instruments. More particularly, our invention concerns a storage target for use in such storage tubes.

2. Description of the Prior Art

According to the typical configuration of a prior art storage target or storage mesh used in a direct-view storage tube for a storage-type oscilloscope, a porous dielectric storage layer is attached to or formed on a fine meal mesh screen or electrode. Usually, the storage mesh is formed by atmospheric vapor deposition of a dielectric comprising magnesium oxide on the metal mesh, as of nickel or copper, while the latter is being supported levelly by a metal frame.

The dielectric is deposited on the metal mesh to a thickness of several tens of microns with a view to minimal electrostatic capacity. Being so porous or loosely packed, the dielectric storage layer of the prior art target has a coefficient of density of not more than 0.1 or so.

By the term "density coefficient", as used herein and in the claims appended hereto, is meant the ratio of the apparent specific gravity of a material or formed product to the intrinsic specific gravity of a closely packed or unintersticed material. Thus any unintersticed or nonporous material or formed product has a density coefficient of one.

Such has been the configuration of the prior art storage target that the dielectric can be deposited to a thickness of only several microns at the maximum in order to form a dielectric storage layer having a higher density coefficient. This is because the dielectric deposited on the nickel or copper mesh to a greater thickness is easy to develop cracks or separate therefrom due to the difference between their coefficient of thermal expansion.

The dielectric storage layer with a sufficiently low density coefficient is practically free from the problems of cracking and separation, even if the layer has a thickness of several tens of microns as above. Because of the low density coefficient, however, the dielectric storage layer provides a low secondary electron emission ratio and low writing speed. The low density storage layer has the additional disadvantage of short service life, being susceptible to "burning" or thermal damage from electron beam bombardment.

A direct-view storage tube of modified design has been suggested in which an additional storage mesh is disposed between and parallel to the first storage mesh and the phosphor screen of the storage tube. The second storage mesh is identical in configuration with the first except that the second has a dielectric storage layer of reduced thickness for an increase in electrostatic capacity. Information is first written on the first storage mesh at high speed. Since the first storage mesh provides a short display persistence, the information is thence transferred on to the second storage mesh for reading.

The direct-view storage tube of this dual storge mesh type also has the disadvantages of low writing speed and the easy burning of the meshes. The use of the two storage meshes, moreover, incurs a substantial decrease in the transmission rate of the electron beams, providing low-output brightness in non-storage operation.

The so-called "reduced mode" of operation has been employed extensively in order to increase writing speed. Let it be assumed that the cathode of the writing gun in a direct-view storage tube has a potential of −2 kilovolts in the normal mode of operation. For the reduced mode of operation a potential of, say, −4 kilovolts is applied to the writing gun cathode, while the deflection system of the storage tube is maintained just as in the normal mode of operation. Through the consequent increase in electron beam density, the writing speed is increased, as from 30 megahertz in the normal mode up to 200 megahertz in the reduced mode.

An objection to this reduced mode of operation is that the storage mesh becomes even more susceptible to burning because of the increased electron beam acceleration energy and increased electron density. Another objection is the inevitable decrease in display area.

SUMMARY OF THE INVENTION

It is an object of our invention to provide an improved storage target for a direct-view storge tube which permits writing operation to be performed at much higher speed than has been possible heretofore.

Another object of our invention is to extend the useful life of such a storage target by making same practically immune to the heat generated by electron beam bombardment.

A further object of our invention is to provide such a storage target which is easier to fabricate than the prior art target including a metal mesh.

A still further object of our invention is to provide such a storage target suitable to be integrally combined with the collector electrode of a direct-view storage tube.

Our invention can be summarized as a storage target comprising a dielectric storge medium in the form of a relatively rigid sheet of insulating material having a density coefficient of at least about 0.7, and a film electrode of conductive material formed on one of the surfaces of the dielectric storage medium. A plurality of more or less regularly patterned openings are defined by, and extend through, the dielectric storage medium and the film electrode.

Preferably, the dielectric storage medium is formed by a single crystal sheet of sapphire or other insulating material having a density coefficient of substantially one. The film electrode can usually be fabricated by vapor deposition or cathode sputtering of metal on the dielectric storage medium. The openings in the dielectric storge medium and film electrode may be formed either by photoetching, by laser or electron beam drilling, or by mechanical cutting.

Thus, in contradistinction to the prior art in which a dielectric storage layer is formed by depositing a desired insulating material on a metal mesh electrode, our invention proposes the dielectric storage medium in the form of a sheet of insulating material having a high density coefficient, the storage medium serving as a supporting substrate for the film electrode deposited thereon. This dielectric storage medium provides a remarkably high secondary emission ratio in comparison with that according to the prior art, making possible an increase in writing speed. By virtue of its high density coefficient, moreover, the dielectric storage medium is to suffer hardly any damage from the heat of electron beam bombardment. Still further, the dielectric storage medium with its high secondary emission ratio permits a decrease in the acceleration energy and electron density of the writing beam if writing is to be effected at the same speed as heretofore. The thermal damage to the dielectric storage medium can be further reduced in this case.

In additional embodiments of our invention the storage target of the above configuration is integrally combined with the collector electrode of a direct-view storage tube. The collector electrode is formed on the surface of the dielectric storage medium opposite to its surface having the film electrode attached thereto. Advantageously, the collector electrode can be readily fabricated from a metal mask employed for etching the openings in the dielectric storage medium. Thus integrated with the storage target, moreover, the collector electrode is also highly resistive to the heat of electron beam bombardment.

The above and other objects, features and advantages of our invention and the manner of attaining them will become more readily apparent, and the invention itself will best be understood, from the following description and appended claims taken in conjunction with the accompanying drawings.

DESCRIPTION OF THE PREFERRED EMBODIMENTS

Figure 1:
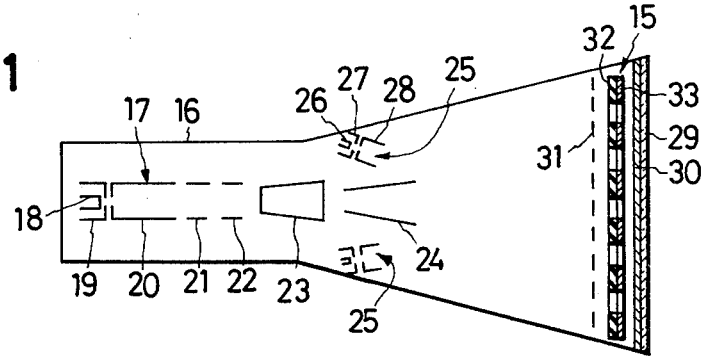
FIG. 1 is a schematic sectional view of a direct-view storage tube including a preferred form of the storage target in accordance with our invention.

In FIG. 1 the improved storage target of our invention is generally designated 15 and is shown mounted in position in a direct-view storage tube of known overall configuration for application to a storage-type oscilloscope. The storage tube has a vacuum envelope 16. Mounted within this vacuum envelope, adjacent the rear end thereof, is a writing gun 17 comprising a cathode 18, first grid 19, second grid 20, first anode 21, second anode 22, Y-deflector 23, and X-deflector 24, which are arranged as shown. The vacuum envelope 16 further houses a pair of flood guns 25 for reading and erasing each comprising a cathode 26, first grid 27, and second grid 28.

The front end of the vacuum envelope 16 is closed by a faceplate 29, behind which there is mounted a phosphor screen 30 for visible display of information. Further behind this phosphor screen there are disposed the storage target 15 of our invention and a collector mesh 31.

Figure 2:
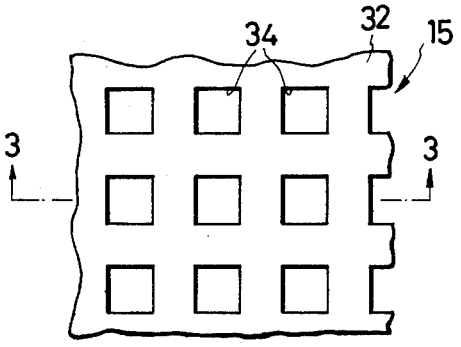
FIG. 2 is an enlarged, fragmentary elevational view of the storage target used in the storage tube of FIG. 1.
Figure 3:
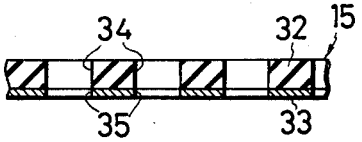
FIG. 3 is a sectional view take along the line 3—3 of FIG. 2.

As will be best seen from its enlarged representations given in FIGS. 2 and 3, the storage target 15 comprises a dielectric storage medium 32 formed by a relatively rigid sheet of insulating material having a density coefficient (as defined above) of at least about 0.7, and a thin film electrode 33 formed on one of the surfaces of the dielectric storage medium and supported thereby. The metal mesh of the prior art storage target is not employed.

The lower limit of the density coefficient is set at about 0.7, as above, because no satisfactory secondary emission ratio is obtained by use of a sheet of insulating material having a density coefficient of less than this limit. The dielectric storage medium formed by such a sheet of insulating material is also objectionable by reasons of its poor mechanical strength and susceptibility to damage fom the heat of electron bombardment.

In this particular embodiment of our invention the dielectric storage medium 32 is formed by a sheet of the single crystal of synthetic sapphire having a thickness ranging from 0.1 to 0.5 millimeter. The density coefficient of this single crystal sheet of sapphire is of course one. The dielectric storage medium 32 has an array of square openings 34 formed therein.

The film electrode 33 may be formed by vapor deposition of nickel on one of the surfaces of the dielectric storage medium 32, the nickel deposit having a thickness of approximately one micron. The film electrode 33 also has formed therein an array of square openings 35 in precise register with the storage medium openings 34.

It is to be understood that the single crystal of sapphire and the deposit of nickel employed for the dielectric storage medium 32 and the film electrode 33 in this embodiment are arbitrary choices. The dielectric storage medium 32 can be formed by any of the single crystals, preferably synthetic, of magnesium oxide (MgO), magnesia-alumina or spinel ($MgO.Al_2O_3$), calcium fluoride ($CaF_2$), and magnesium fluoride ($MgF_2$), in addition to sapphire ($Al_2O_3$). The single crystals of these materials should be of as high purity, and as free from lattice defects, as possible. Although such synthetic single crystals are preferred, the dielectric storage medium 32 may also be formed by sheets or plates of silica ($SiO_2$) glass, high-purity glass, rock crystal and the like.

The film electrode 33 may usually be made from any suitable metal, as by vapor deposition or sputtering. If desired, stannic oxide or like substance may be employed to provide a transparent film electrode.

In the use of the single crystal of sapphire for the dielectric storage medium 32, as in this embodiment, the surface of the storage medium to be bombarded by incident electrons may be formed by any desired crystal face. Particularly desired ones, however, are r (1$\bar{1}$02), a (10$\bar{1}$0) and c (0001) crystal faces.

Figure 4A:
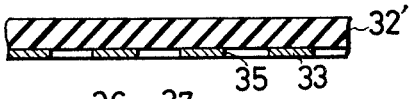
FIGS. 4A, 4B, 4C and 4D are a series of sectional views illustrating the sequential steps of manufacturing the storage target of FIGS. 2 and 3, the illustrated manufacturing method being but an example of various possible methods.

A consideration of FIGS. 4A through 4D will make clear a preferred method of making the storage target 15. With reference first to FIG. 4A, a blank 32' for the dielectric storage medium 32 is first prepared by suitably processing the opposite faces of a synthetic single crystal sheet of sapphire into a mirrorlike finish. Preferably, the electron-bombarded surface of this dielectric storage madium blank 32' is formed by the r face of the single sapphire crystal.

Nickel is then vapor deposited uniformly on one of the surfaces of the dielectric storage medium blank 32'. A photoresist is then coated over the nickel deposit. The photoresist coating is then masked, exposed, and developed to form an array of openings therein. The corresponding array of openings are then formed in the nickel deposit by etching through the resist coating openings. The resist coating is then removed, leaving the film electrode 33 having the openings 35 on the dielectric storage medium blank 32' as shown in FIG. 4A.

Figure 4B:
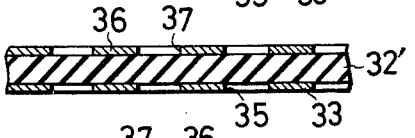

The next step, illustrated in FIG. 4B, is the formation of a metal mask 36 on the other surface of the dielectric storage medium blank 32'. The metal mask 36 has an array of openings 37 formed therein in register with the openings 36 in the film electrode 33. The metal mask 36 with its openings 37 can be formed in exactly the same manner as the film electrode 33 with its openings 35.

Unlike a sapphire layer formed by sputtering or by chemical vapor deposition, the single crystal of sapphire can hardly be etched with the mixture of hydrofluoric acid and nitric acid or with heated phosphoric acid. The heated solution of potassium hydroxide is believed to be best suited for use as an etchant for the single crystal of sapphire. Since an organic resist is not resistive to the potassium hydroxide etchant, there is employed in this embodiment the metal mask 36 which may be of either nickle or chromium.

Figure 4C:
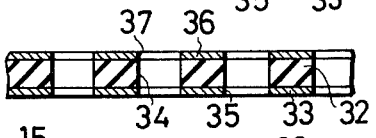
Figure 4D:
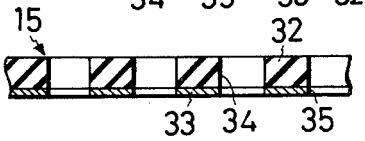

The article of FIG. 4B is immersed in the heated solution of potassium hydroxide for etching away the undesired portions of the dielectric storage medium blank 32' through the metal mask openings 37. FIG. 4C shows the dielectric storage medium 32 having the array of openings 34 thus formed therein in register with the openings 35 in the film electrode 33. The desired storage target 15 can be completed as shown in FIG. 4D upon removal of the metal mask 36 from the article of FIG. 4C.

The storage target 15 configured and manufactured as above has been experimentally confirmed to provide a remarkably high secondary emission ratio, obviously because its dielectric storage medium 32 is formed by a sheet of material (single crystal of sapphire) having a high density coefficient instead of by a vapor-deposited magnesium oxide or the like as in the prior art. One possible explanation for this is that according to the prior art storage target with its dielectric storage layer of an extremely low density coefficient, primary electrons are easy to penetrate deep into the pores of the storage layer, resulting in the liberation of a fewer number of secondary electrons. Contrastively, according to the inventive storage target 15 with its dielectric storage medium 32 of a high density coefficient, primary electrons do not penetrate into the storage medium, making possible the emission of a greater number of secondary electrons.

The secondary emission ratio can be further improved by employing a single crystal sheet of sapphire for the dielectric storage medium 32 as in the above embodiment. Thus, with the use of this storage target 15, the writing speed can be increased to, for example, 200 megahertz, which is approximately ten times as high as that according to the prior art. The storage target 15 is further characterized by its resistivity to electron beam bombardment, suffering little or no thermal damage therefrom. The writing speed can be still more increased by employing the reduced mode of operation. It is noteworthy that the storage target 15 suffers hardly any thermal damage even in the reduced mode.

As has been mentioned, the dielectric storage medium 32 can be fabricated from any of the listed materials in addition to sapphire. With the dielectric storage medium 32 made from a sheet of silica glass, for example, which has a density coefficient of approximately one, the writing speed can be made twice as high as that according to the prior art. Further, with the dielectric storage medium 32 made from a single crystal sheet of magnesium oxide, calcium fluoride, or magnesium fluoride, the writing speed can be made four to five times as high as that according to the prior art. The dielectric storage media made from all these materials have also been experimentally confirmed to suffer hardly any thermal damage from electron beam bombardment.

It has been mentioned that in the embodiment of FIGS. 1 through 3, the electron-bombarded surface of the dielectric storage medium 32 is formed by the r face of the single crystal of sapphire. The secondary eemission ratio in this case is approximately twice as high as that in the case where the other crystal faces are employed for the electron-bombarded surface of the dielectric storage medium.

A further advantage of the storage target according to our invention is that as has also been experimentally confirmed, its secondary emission ratio is particularly high when the writing beam is applied thereto with an energy of five to 10 kilo electron volts. The secondary emission ratio is further improved at over 10 kilo electron volts when the dielectric storage medium 32 is made from a single crystal sheet of sapphire as in the above embodiment. The writing speed can also be correspondingly increased.

Among the possible reasons for the above high equivalent secondary emission ratio are (1) the noted increase in the number of so-called secondary electrons emitted from the single crystal storage medium, and (2) the multiplication of electrons within the solid due to hole-electron couples generated therein. It has been ascertained by experiment that the multiplication of electrons within the storage medium depends greatly upon the purity, and the degree of freedom from lattice defects such as dislocations, of the single crystal sheet of desired insulating material employed.

In the manufacture of the storage target 15 according to our invention, as explained above in connection with FIGS. 4A through 4D, the dielectric storage medium 32 is used as the substrate for the formation of the film electrode 33 thereon. This is quite contrary to the conventional practice of depositing a dielectric storage layer on an electrode in the form of a metal mesh. The storage target according to our invention is easier to manufacture since it eliminates the step of mounting the metal mesh on a supporting frame for the deposition of the dielectric storage layer thereon.

Second Embodiment

Figure 5:
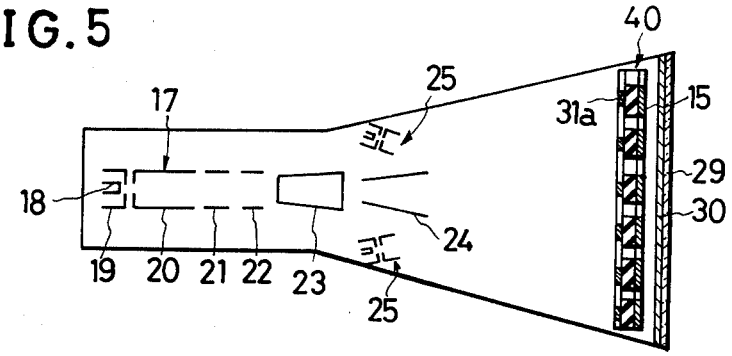
FIG. 5 is a schematic sectional view of a direct-view storage tube including another preferred form of the storage target in accordance with our invention, the storage target being integrally combined with the collector electrode of the storage tube.
Figure 6:
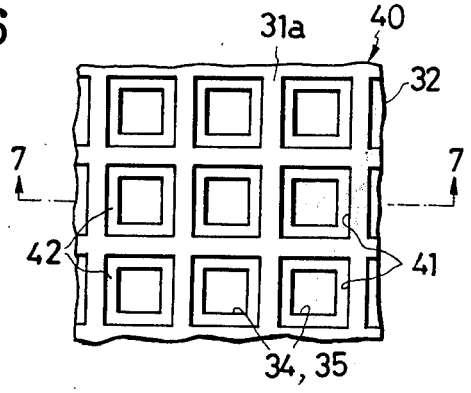
FIG. 6 is an enlarged, fragmentary elevational view of the target-collector combination used in the storage tube of FIG. 5.
Figure 7:
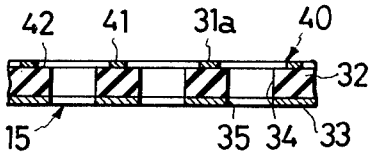
FIG. 7 is a sectional view taken along the line 7—7 of FIG. 6.

FIGS. 5 through 7 illustrate the second preferred embodiment of our invention, in which the storage target 15 is integrally combined with a collector electrode 31*a* for use in the direct-view storage tube of essentially the same design as that shown in FIG. 1. The target-collector combination is generally designated 40 in FIG. 5 and is therein shown mounted in position within the storage tube.

As will be seen also from its enlarged plan and sectional views given in FIGS. 6 and 7, the target-collector combination 40 comprises the dielectric storage medium 32 in the form of, for example, a single crystal sheet of sapphire, the film electrode 33 formed on the storage medium surface directed toward the phosphor screen 30 of the storage tube, and the collector electrode 31*a* formed on the other surface of the storage medium. It is thus seen that the storage target itself of this target-collector combination 40 is constructed just as in the preceding embodiment. The method of maufacturing the storage target can also be just as described above with reference to FIGS. 4A through 4D.

The collector electrode 31*a* has formed therein an array of square openings 41 in register with the storage medium openings 34 and film electrode openings 35. Each collector electrode opening 41 is, however, made greater in size than each storage medium opening 34 in order that parts 42 of the dielectric storage medium 32 may be left exposed through the collector electrode openings. These exposed parts 42 of the dielectric storage medium 32 are intended to be bombarded by incident electrons.

The formation of the collector electrode 31*a* on the storage target 15 is extremely easy. It will be recalled that in the manufacture of the storage target 15 through the procedure of FIGS. 4A through 4D, the metal mask 36 is employed to form the openings 34 in the dielectric storage medium 32. Instead of removing this metal mask 36 following the formation of the storage medium openings 34, the metal mask openings 37 may be enlarged to the required size of the collector electrode openings 41. The metal mask 36 can thus be turned into the collector electrode 31*a* combined with the storage target 15.

In addition to the listed advantages possessed by the storge target 15 itself, the target-collector combination 40 of this embodiment is advantageous in the extreme ease with which the collector electrode 31*a* is fabricated. It has been known to integrally attach a collector electrode or mesh to the dielectric storage layer of a storage target. The storage layer of the prior art storage target has had such a low density coefficient, however, that it has been impossible to perform the required photoetching process thereon.

The conventional practice, therefore, has been to form a separate collector mesh and then to attach same to the dielectric storage layer of the target. Thus formed and integrated with the storage target, the collector mesh is highly susceptible to thermal damage from electron beam bombardment, udergoing evaporation in the worst case.

Contrastively, in the target-collector combination 40 of our invention, the collector electrode 31*a* can be formed by vapor deposition or sputtering of desired metal on the dielectric storage medium 32. The thus-realized high degree of adhesion of the collector electrode 31*a* to the dielectric storage medium 32 affords good heat transfer therebetween, resulting in the improved immunity of the collector electrode from thermal impairment due to electron beam bombardment. It should be appreciated that these advantages of the target-collector combination 40 are gained through the dielectric storage medium 32 made by a relatively rigid sheet of insulating material having a high density coefficient.

Third Embodiment

The third preferred embodiment of our invention shown in FIGS. 8 through 11 is also directed to a target-collector combination 40*a* which may be employed in place of the target-collector combination 40 in the direct-view storage tube of FIG. 5. The modified target-collector combination 40*a* comprises a storage target 15*a* and collector electrode 31*b*. The storage target 15*a* is itself slightly modified in configuration, so that this target will first be described.

Figure 9:
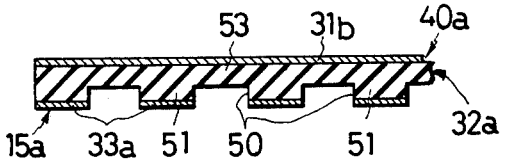
FIG. 9 is a sectional view taken along the line 9—9 of FIG. 8.
Figure 10:
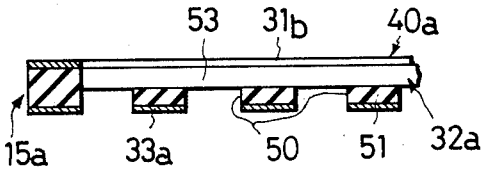
FIG. 10 is also a sectional view taken along the line 10—10 of FIG. 8.

The modified storage target 15*a* includes a dielectric storage medium 32*a*, preferably formed by a single crystal sheet of sapphire. This dielectric storage medium 32*a* has a first group of parallel spaced grooves 50 formed in its surface to be directed toward the phosphor screen 30 of the storage tube, as best seen in FIGS. 9 and 10. Each groove 50 has a depth equal to one half of the thickness of the dielectric storage medium 32*a*. Also included in the modified storage target 15*a* is a film electrode 33*a* in the form of thin strips of nickel covering the surfaces of lands 51 between the grooves 50. The nickel strips are interconnected at their ends.

Figure 8:
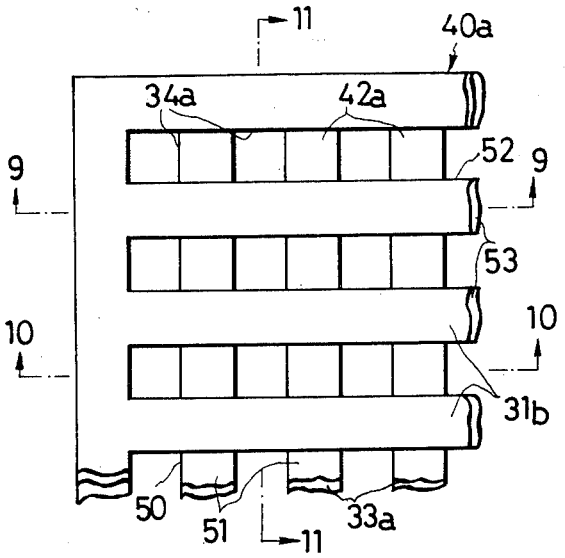
FIG. 8 is a fragmentary elevational view of another example of target-collector combination in accordance with our invention.
Figure 11:
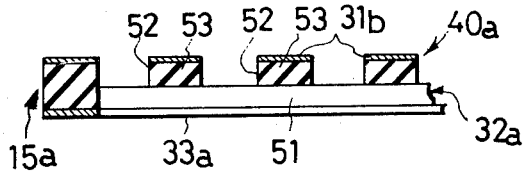
FIG. 11 is also a sectional view taken along the line 11—11 of FIG. 8.

A second group of parallel spaced grooves 52 are formed in the other surface of the dielectric storage medium 32*a*, which is to be directed away from the phosphor screen 30, as best seen in FIGS. 8 and 11. Extending in right angular relationship to the first group of grooves 50, the second group of grooves 52 have each a depth equal to one half the thickness of the dielectric storage medium 32*a*. It wil thus be seen that the first 50 and second 52 groups of grooves serve to form in combination an array of openings 34*a* at their crossing points extending through the dielectric storage medium 32*a*.

The collector electrode 31*b* of this target-collector combination 40*a* also takes the form of thin strips of nickel covering the surfaces of lands 53 between the second group of grooves 52. These nickel strips are also interconnected at their ends. The dielectric storage medium 32*a* has surface portions 42*a* exposed through the spaces between the collector electrode strips 31*b*, to be bombarded by incident electrons.

Among the advantages of this third embodiment is the greater ease with which the target-collector combination 40*a* is manufactured. In the embodiment of FIGS. 5 through 7 the openings 37 in the metal mask 36 must be enlarged for the use of the metal mask as the collector electrode 31*a*. The collector electrode 31*b* of this third embodiment requires no such manufacturing step. The target-collector combination 40*a* can be manufactured through essentially the same steps as those represented in FIGS. 4A through 4C for the manufacture of the storage target 15. It will be evident that the target-collector combination 40*a* possesses the other advantages listed in connection with the preceding two embodiments.

Although we have shown and described our invention in terms of several preferred embodiments thereof, it is to be understood that our invention is not to be restricted by the exact details of such embodiments, since numerous changes or modifications will readily occur to those skilled in the art. For example, the thickness of the dielectric storage medium can be made less than the specified range of 0.1 to 0.5 millimeter, if its peripheral edges are suitably thickened to serve as supporting frame. Further, the shape of the openings formed through the storage target or target-collector combination may not necessarily be square but may, for example, be circular, rectangular, polygonal, etc.

It is also understood that the storage target or target-collector combination of our invention is applicable to direct-view storage tubes of other than the illustrated configuration, and not only to those of the illustrated electrostatic deflection type but also to those of the electromagnetic deflection type. If desired or required, moreover, the storage target may be disposed in contact with the phosphor screen of a storage tube for bistable visual signal display. All these and other modifications or changes within the usual knowledge of the specialists are intended to be comprehended within the scope of our invention.

We claim:

1. In a direct-view storage tube, in combination, a dielectric storage medium in the form of a relatively rigid sheet of insulating material having a density coefficient of at least about 0.7, the dielectric storage medium having a first and a second group of parallel spaced grooves formed in its opposite surfaces, the first and the second groups of grooves extending in right angular relationship to each other and forming an array of openings at their crossing points, a film electrode in the form of interconnected strips of conductive material deposited on the surfaces of lands between the first group of grooves in the dielectric storage medium, the dieletric storage medium and the film electrode forming in combination a storage target, and a collector electrode in the form of interconnected strips of conductive material formed on the surfaces of lands between the second group of grooves in the dielectric storage medium.

2. The invention as recited in claim 1, wherein the sheet of insulating material has a density coefficient of substantially one.

3. The invention as recited in claim 2, wherein the sheet of insulating material is a single crystal of the insulating material.

4. A storage target for a direct-view storage tube, comprising a storage medium in the form of a relatively rigid sheet of material having a coefficient of density of at least about 0.7, the storage medium having a first and a second group of parallel spaced grooves formed in its opposite surfaces and extending in right angular relationship to each other, there being an array of openings at the crossing points of the first and the second groups of grooves in the storage medium, and a film electrode in the form of interconnected strips of conductive material overlying the surfaces of lands between the first group of grooves in the storage medium.

5. The storage target as recited in claim 4, wherein the first and the second groups of grooves in the storage medium have each a thickness equal to one half of the thickness of the storage medium, whereby the first and the second groups of grooves serve in combination to form the array of openings at their crossing points.

6. The storage target as recited in claims 4 or 5, wherein the density coefficient of the sheet material is approximately one.

7. The storage target as recited in claim 6, wherein the storage medium is a single crystal of insulating material.

8. The storage target as recited in claims 4 or 5, in combination with a collector electrode in the form of interconnected strips of conductive material overlying the surfaces of lands between the second group of grooves in the storage medium.

* * * * *

UNITED STATES PATENT AND TRADEMARK OFFICE

CERTIFICATE OF CORRECTION

PATENT NO. : 4,262,230

DATED : April 14, 1981

INVENTOR(S) : Takefumi Kato and Hajime Takita

It is certified that error appears in the above-identified patent and that said Letters Patent are hereby corrected as shown below:

Column 1, line 17, "meal" should read -- metal --.

Column 1, line 66, "storge" should read -- storage --.

Column 2, line 40, "storge" should read -- storage --.

Column 2, line 54, "storge" should read -- storage --.

Column 4, line 30, "form" should read -- from --.

Column 4, line 51, "($MgO.AL_2O_3$)" should read -- ($MgO \cdot Al_2O_3$) --.

Column 5, line 25, "36" first occurrence should read -- 35 --.

Column 6, line 31, "eemission" should read -- emission --.

UNITED STATES PATENT AND TRADEMARK OFFICE

CERTIFICATE OF CORRECTION

PATENT NO. : 4,262,230

DATED : April 14, 1981

INVENTOR(S) : Takefumi Kato and Hajime Takita

It is certified that error appears in the above-identified patent and that said Letters Patent are hereby corrected as shown below:

Column 7, line 21, "maufacturing" should read -- manufacturing --.

Column 7, line 60, "udergoing" should read -- undergoing --.

Column 8, line 38, "wil" should read -- will --.

Signed and Sealed this

First Day of December 1981

[SEAL]

Attest:

GERALD J. MOSSINGHOFF

Attesting Officer

Commissioner of Patents and Trademarks